US005918694A

United States Patent [19]

Miller et al.

[11] Patent Number: 5,918,694

[45] Date of Patent: Jul. 6, 1999

[54] PIVOTABLE CONTROL LEVER MECHANISM

[75] Inventors: Gordon Edward Miller, Lenoir City, Tenn.; Leslie Harold Schult, Waseca, Minn.

[73] Assignee: Deere & Company, Moline, Ill.

[21] Appl. No.: 08/953,560

[22] Filed: Oct. 17, 1997

[51] Int. Cl.[6] ..... B62D 33/067

[52] U.S. Cl. ..... 180/89.14; 180/328; 414/685

[58] Field of Search ..... 180/89.12, 89.13, 180/89.14, 89.15, 89.16, 89.18, 89.19, 327, 328, 330, 331, 334; 280/756; 74/473.1, 469; 414/680, 685, 686, 914

[56] References Cited

U.S. PATENT DOCUMENTS 4,276,953 7/1981 Penzotti et al. ..... 180/328
4,982,619 1/1991 Thoreson ..... 180/328
5,042,602 8/1991 Nakatani et al. ..... 180/89.14
5,518,358 5/1996 Aschroft et al. ..... 414/685
5,553,992 9/1996 Aschroft ..... 414/685

*Primary Examiner*—Paul N. Dickson

[57] ABSTRACT

A skid steer loader control linkage engageable by an operator for controlling speed and direction of the vehicle. The control linkage operatively engages a roll over protection structure that is shiftable between a lowered operating position and a raised position whereat vehicle compartments are exposed for access by the operator. The engagement of the control linkage against the roll over protection structure shifts the control linkage between an operative position and an inoperative position as the roll over protection structure shifts between the raised and lowered positions.

18 Claims, 6 Drawing Sheets

PIVOTABLE CONTROL LEVER MECHANISM

This invention relates to control levers that are provided on skid steer loader vehicles having ROPS that pivot to expose a vehicle compartment.

Conventional skid steer loader vehicles utilize "steering by driving" systems. In other words. To execute a right hand turn the operator causes the drive wheels on the right side of the vehicle to be slowed with respect to the drive wheels on the left side of the vehicle. This causes the vehicle to execute a turn to the right. Likewise, to execute a turn to the left, the operator causes the drive wheels on the left side of the vehicle to be slowed with respect to the drive wheels on the right side of the vehicle. During straightforward travel the operator causes drive wheels on both sides of the vehicle to be driven at equal speeds. Conventional skid steer loaders provide left and right hand levers engageable by an operator seated on the vehicle. The operator controls the speed and direction of the right or left drive wheels by pivoting the respective right or left hand levers. Other vehicle functions, such as control of the loader arms and the tilt of the loader bucket are also often controlled by the hand levers. The end portions of the hand levers are typically pivotable side to side with respect to the lower portion of the lever for controlling these other vehicle functions.

It is known to provide skid steer loader vehicles with ROPS, or roll over protection structures. These structures generally surround the operator seated in the operator station and help prevent the operator from being harmed if the vehicle rolls. It is also known to provide ROPS structures that pivot or slide out of their normal position such that clearance is provided for an operator to access internal vehicle compartments beneath the seat that house vehicle components such as the hydraulic system. Typically the ROPS structure will slide forwardly, or pivot upwardly so that the operator can reach over the sides of the vehicle to perform maintenance on the internal compartments of the vehicle. Often the floor of the operator compartment and the operator seat will be coupled with the ROPS structure so that they pivot up with the ROPS. The compartments are thereby exposed as the ROPS pivot up without requiring the operator to separately remove the seat or floor panels to access the compartments.

The hand levers of conventional skid steer loader vehicles remain stationary as the ROPS are pivoted to their raised positions. The ROPS and floor portion that pivots with the ROPS must clear the hand controls as they pivot upwardly.

Conventional skid steer loader provide ROPS which pivot about an axis located such that interference between the levers and the floor portion is eliminated. The pivot axis of this type of vehicle tends to be located relatively low such that the arc swung by the ROPS and floor portion extends in a generally vertical direction initially such that the ROPS and floor portion clear the levers. However, providing a low pivot axis for the ROPS and floor portion causes the ROPS to be located at a relatively low position when it has been completely pivoted upwardly, and therefore the ROPS and floor portion may not provide much access to the compartment. Furthermore, providing a ROPS that pivots about a high axis, such as one located above and behind the operator, allows the ROPS to pivot upwardly without contacting or interfering with cross members that extend transversely across the vehicle between the boom arm linkages on each side of the vehicle. Prior art ROPS that pivot about a relatively low pivot axis generally do not allow the vehicle to be provided with a high cross member extending between the right and left side boom linkages, since the ROPS would be blocked from pivoting by the presence of the high cross member. It would be desirable for such a cross member to be high enough so that it does not block or obstruct the operator's line of sight to the rear.

Furthermore, when the ROPS structure is pivoted up to provide access to the compartment, the presence of the hand levers of prior art skid steer loaders is an obstruction in the way of easy access to the otherwise exposed compartment beneath the operator station.

It would therefore be desirable to provide a control linkage for a skid steer loader vehicle that allows a pivoting ROPS structure to be provided, and allows the ROPS structure to be pivotable about a pivot axis that is positioned relatively high. It would be desirable for such a vehicle to provide a high pivot axis that would allow a relatively high cross member to extend transversely across the vehicle between the boom arm linkages on each side of the vehicle. It would also be desirable for such a control linkage to provide greater access to the otherwise exposed compartment when the ROPS is pivoted upwardly.

SUMMARY OF THE INVENTION

The present invention provides a hand control linkage for a skid steer loader vehicle. The controls can be manipulated fore and aft by an operator for controlling the speed of respective right and left drive wheels to thereby steer the vehicle. The vehicle includes a ROPS structure which can swing between a lowered operating position whereat the ROPS engages the vehicle frame for generally enclosing and protecting the seated operator and a raised position whereat the raised ROPS allows access to vehicle compartments beneath the seat and floor of the operator station. The control linkage swings downwardly from its upright operative position to its inoperative position as the ROPS are raised to their inoperative position. A lever link of the control linkage engages the underside of the floor portion of the operator station that swings with the ROPS. As the ROPS swings upwardly the floor portion swings upwardly therewith and allows the lever link clearance to also swing upwardly. As the lever link swings upwardly the hand control levers swing downwardly to inoperative positions and thereby provide clearance for the ROPS to swing past the lowered hand control levers. When the hand control levers are in the downwardly oriented inoperative position they also provide greater clearance for the operator to access the compartments within the vehicle frame. When the ROPS are again swung downwardly to be returned to their lowered operative position against the vehicle frame, the underside of the floor portion of the operator station will swing downwardly therewith into abutment with the lever link causing the lever link to swing downwardly. This causes the hand control lever to swing upwardly again to resume its operative position.

The control linkage according to the present invention provides first and second pivot axes. The hand control lever pivots about the first pivot axis as the operator manipulates the levers for steering the vehicle. A motion transmitting link is coupled between the hand lever and a hydraulic input shaft and transmits fore and aft motion of the hand lever to the input shaft for controlling the speed of the respective drive wheel. As the ROPS swings upwardly, the hand lever and lever link pivot about the second pivot axis toward the inoperative position. The motion transmitting link is coupled to the hand lever proximate the second pivot axis such that the motion transmitting link will generally not shift as the hand lever swings to its inoperative position when the ROPS pivot upwardly. Since the motion transmitting link remains generally stationary as the hand lever and ROPS pivot, the vehicle will also remain stationary.

BRIEF DESCRIPTION OF THE DRAWINGS

FIG. 6 also shows in phantom lines the roll over protection structure in the lowered position and the hand lever control linkage in the operative position.

DETAILED DESCRIPTION OF THE PREFERRED EMBODIMENT

Figure 1:
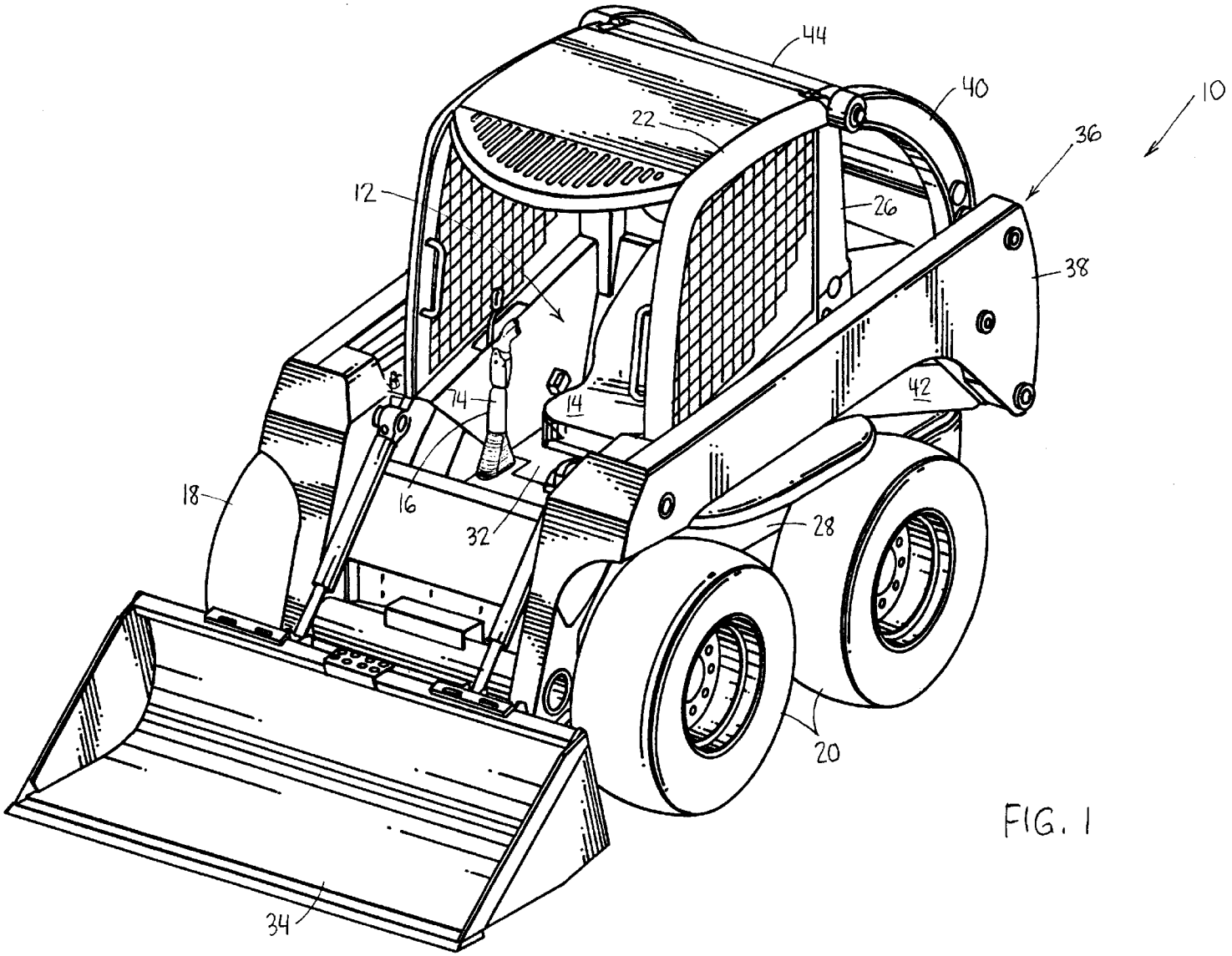
FIG. 1 is a perspective view of the front of a skid steer loader having the hand lever control linkage according to the present invention.

Referring now to FIGS. 1–6, there is shown the preferred embodiment of the present invention. FIGS. 1, 2, 3 and 6 show a skid steer loader vehicle 10 with which the present invention is adapted for use. The vehicle 10 includes an operator station 12 which includes an operator seat 14 and hand control levers 16 operable by the seated operator for controlling the speed of the respective right and left drive wheels 18 and 20. A roll over protection structure, or ROPS 22, is provided for generally enclosing the operator station 12. The ROPS structure 22 helps to protect the operator if the vehicle 10 were to roll over on its side or upside down. The ROPS 22 shown in FIG. 1 is in the operating position whereat the operator station 12 is generally enclosed by the ROPS 22. The ROPS 22 is pivotable about a ROPS pivot axis 24 located above and behind the operator seated on the vehicle 10. The pivot axis 24 is defined in a pair of posts or pillars 26 which extend upwardly from the vehicle frame 28, generally behind the seated operator. The ROPS 22 can be pivoted upwardly about the ROPS pivot axis 24 to the position generally shown in FIGS. 3 and 6. With the ROPS pivoted upwardly to its second position shown in FIGS. 3 and 6, the vehicle compartments 30 beneath the operator seat 14 and floor portion 32 are generally exposed for allowing the operator to access the compartments 30 for maintenance and service operations. The operator seat 14 and floor portion 32 of the operator station 12 form part of the pivoting ROPS structure 22 that swings upwardly to the second position. With the seat and floor portion and ROPS swung upwardly the vehicle compartment 30 is generally exposed for service and maintenance of vehicle components. The compartment 30 is defined between the frame 28 of the skid steer loader 10 and houses vehicle components such as the hydraulic system, which drives the right and left ground engaging drive wheels 18 and 20 of the vehicle 10. The pivoting of the ROPS 22 to provide access to vehicle compartments is described in greater detail in U.S. application Ser. No. 08/954,290, filed Oct. 17, 1997, entitled Operator Enclosure, which is incorporated herein by reference.

The skid steer loader vehicle 10 shown in FIG. 1 includes a loader bucket 34 which is coupled with the vehicle 10 by way of a boom arm structure 36. A main boom arm 38 extends between the bucket 34 and a pair of top links 40. The top links 40 extend between the rearward portion of the boom arm 38 and the upper portion of the pillars 26. The seated operator manipulates controls to move the bucket 34 between its various operating positions. One of the secondary hand controls 70 can be pivoted side to side with respect to the hand lever 16 for controlling the movement of the bucket 34 and boom arm structure 36. As the bucket 34 is raised, the boom arm 38 shifts vertically while generally maintaining its horizontally aligned orientation. As the boom arm 38 shifts vertically the top links 40 pivot about their connections with the pillars 26. This type of boom arm linkage is generally referred to as a vertical lift system, since the main boom arm 38 is lifted generally vertically for raising the bucket 34. The top links 40 and a pair of bottom links 42 which extend between the vehicle 10 and a portion of the main boom arm 38 guide the main boom arm 38 vertically while generally maintaining the horizontal orientation of the boom arm 38.

To generally rigidify the boom arm linkage 36, a cross member 44 is provided which extends between the right and left top link members 40, and between the pillars 26. The cross member 44 serves to rigidify and strengthen the boom arm linkage 36 as the bucket 34 is raised and lowered between its various positions. The cross member 44 according to the preferred embodiment is positioned relatively high and is therefore generally above the operator's line of sight to the rear. The high cross member 44 therefore enhances visibility to the rear of the vehicle 10. The high pivot axis of the ROPS 22 allows the ROPS structure 22 to pivot upwardly and rearwardly without being blocked by the high cross member 44.

Figure 2:
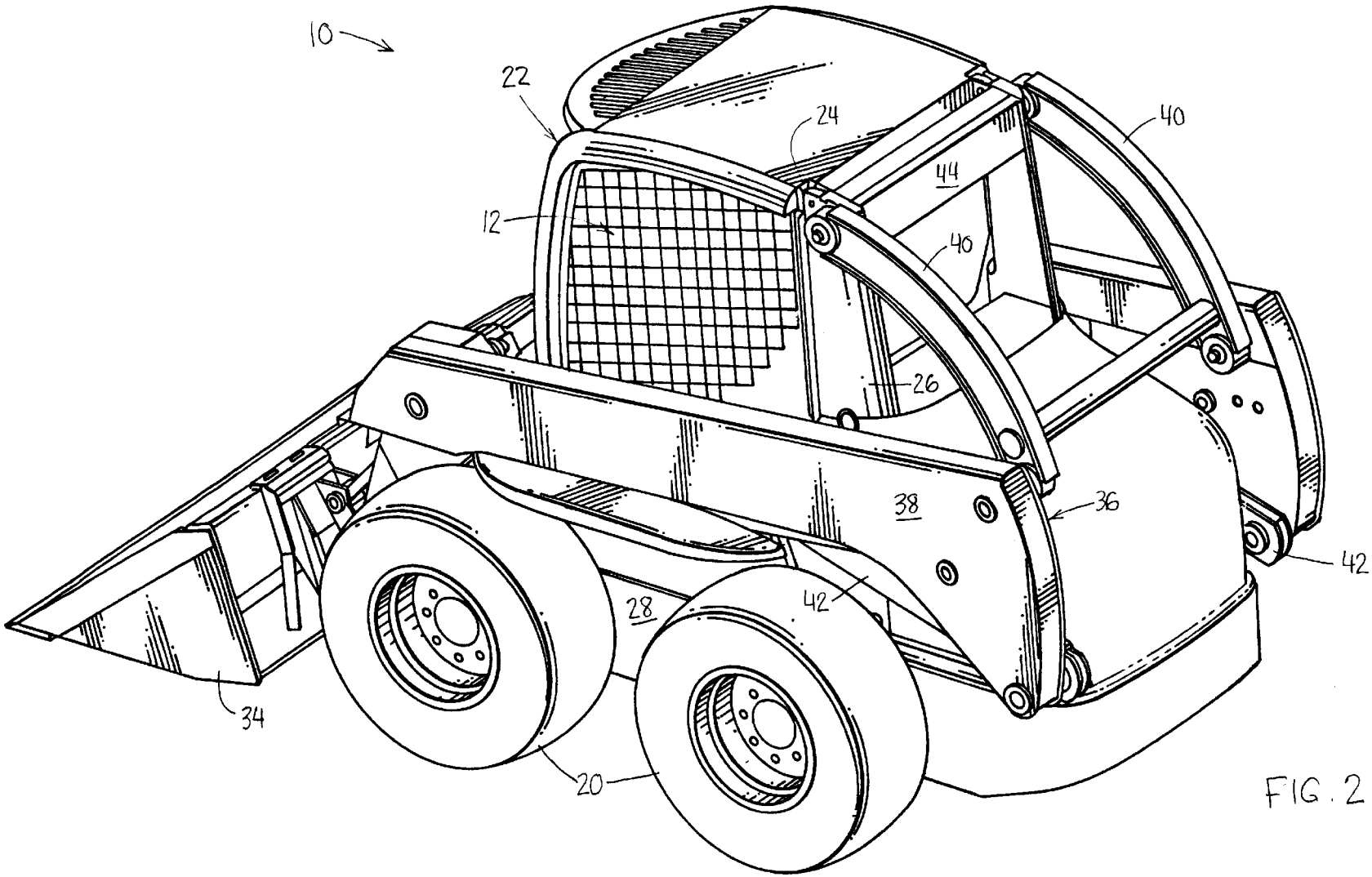
FIG. 2 is a perspective view of the rear of the skid steer loader of FIG. 1.
Figure 3:
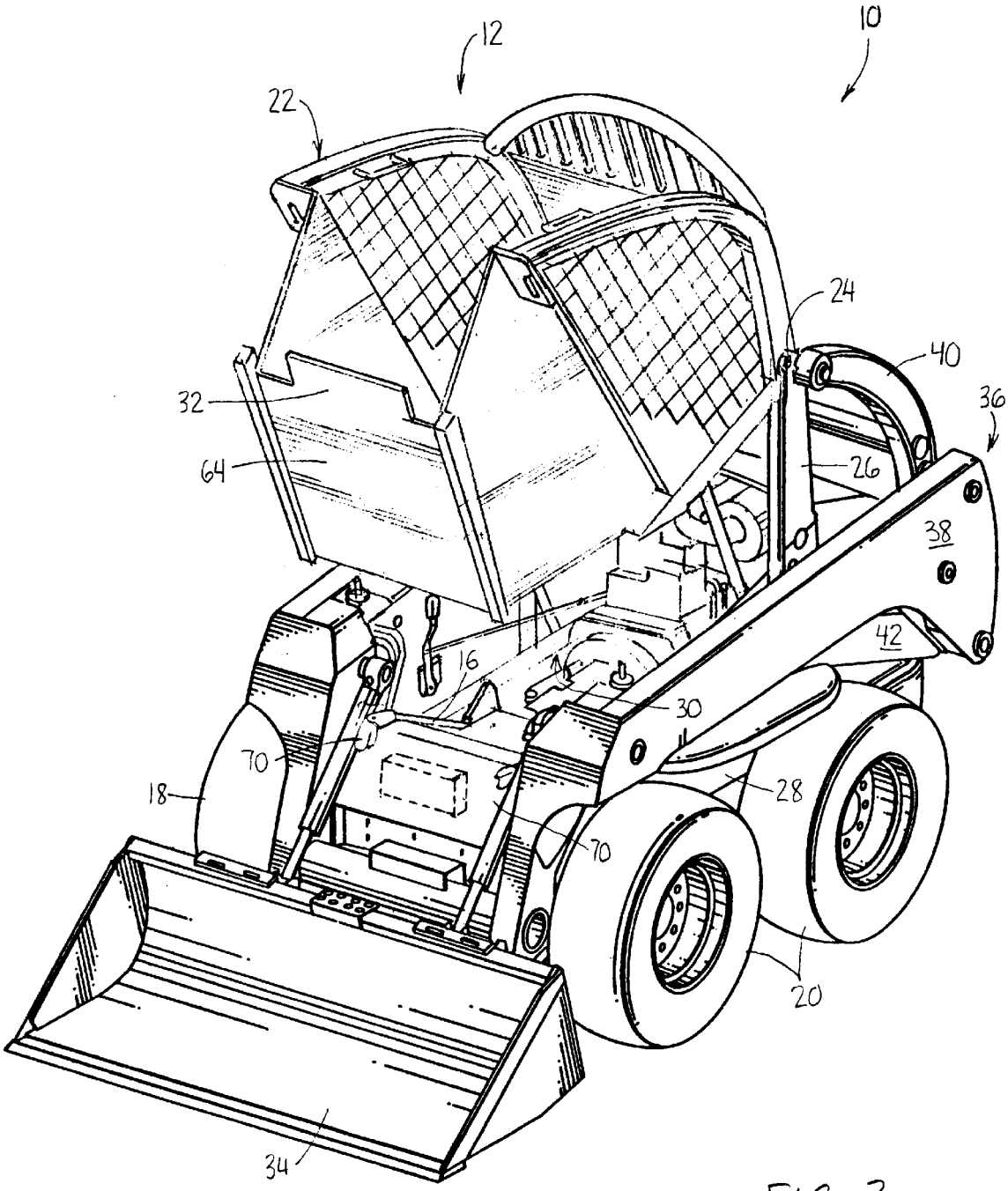
FIG. 3 is a perspective view of the skid steer loader vehicle of FIGS. 1 and 2 showing the hand control linkage pivoted to its lowered inoperative position and the roll over protection structure pivoted to its raised position.
Figure 4:
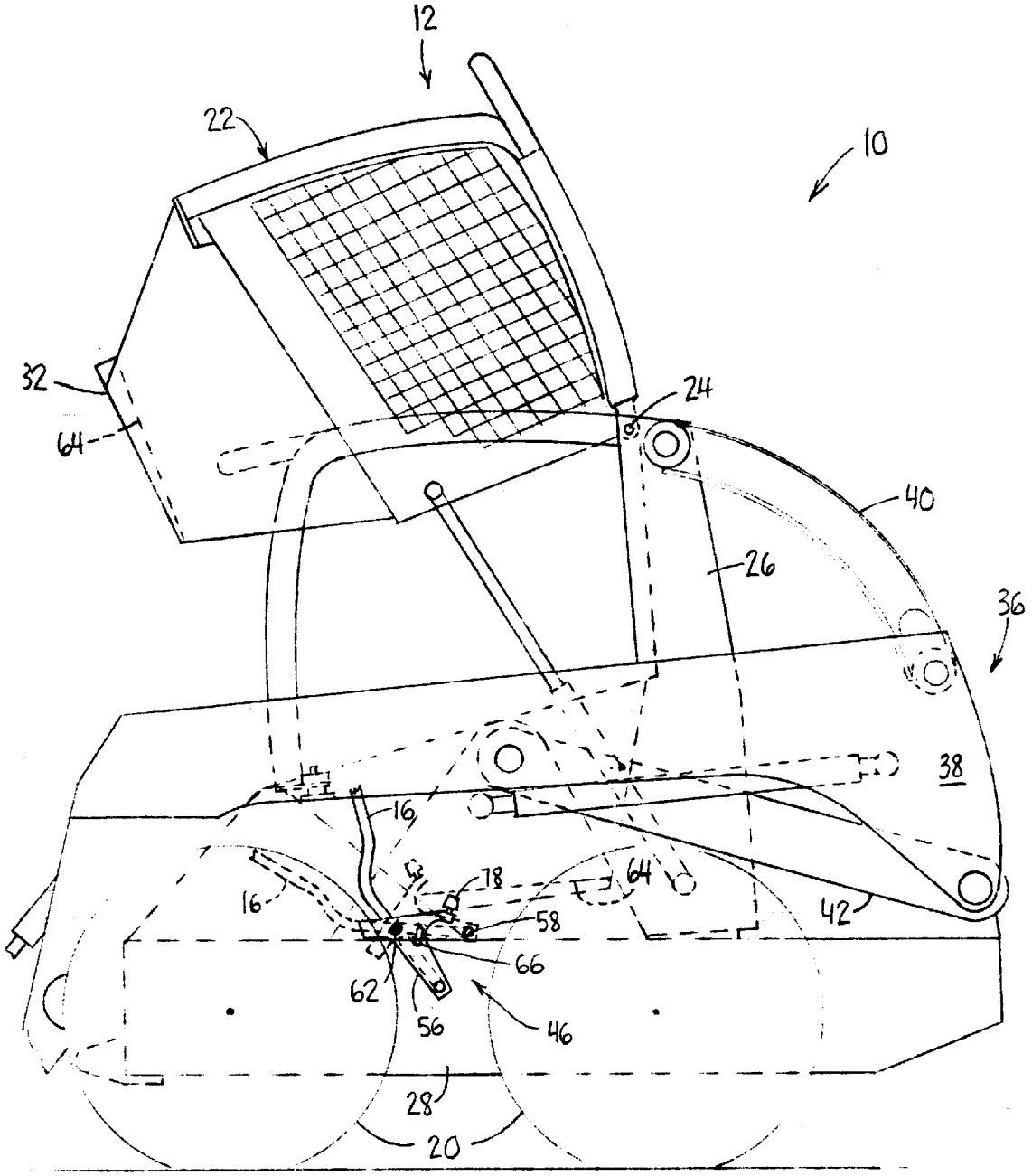
FIG. 4 is a perspective view of the control linkage in the operating position when the roll over protection structure is in its lowered position as shown in FIGS. 1 and 2.
Figure 5:
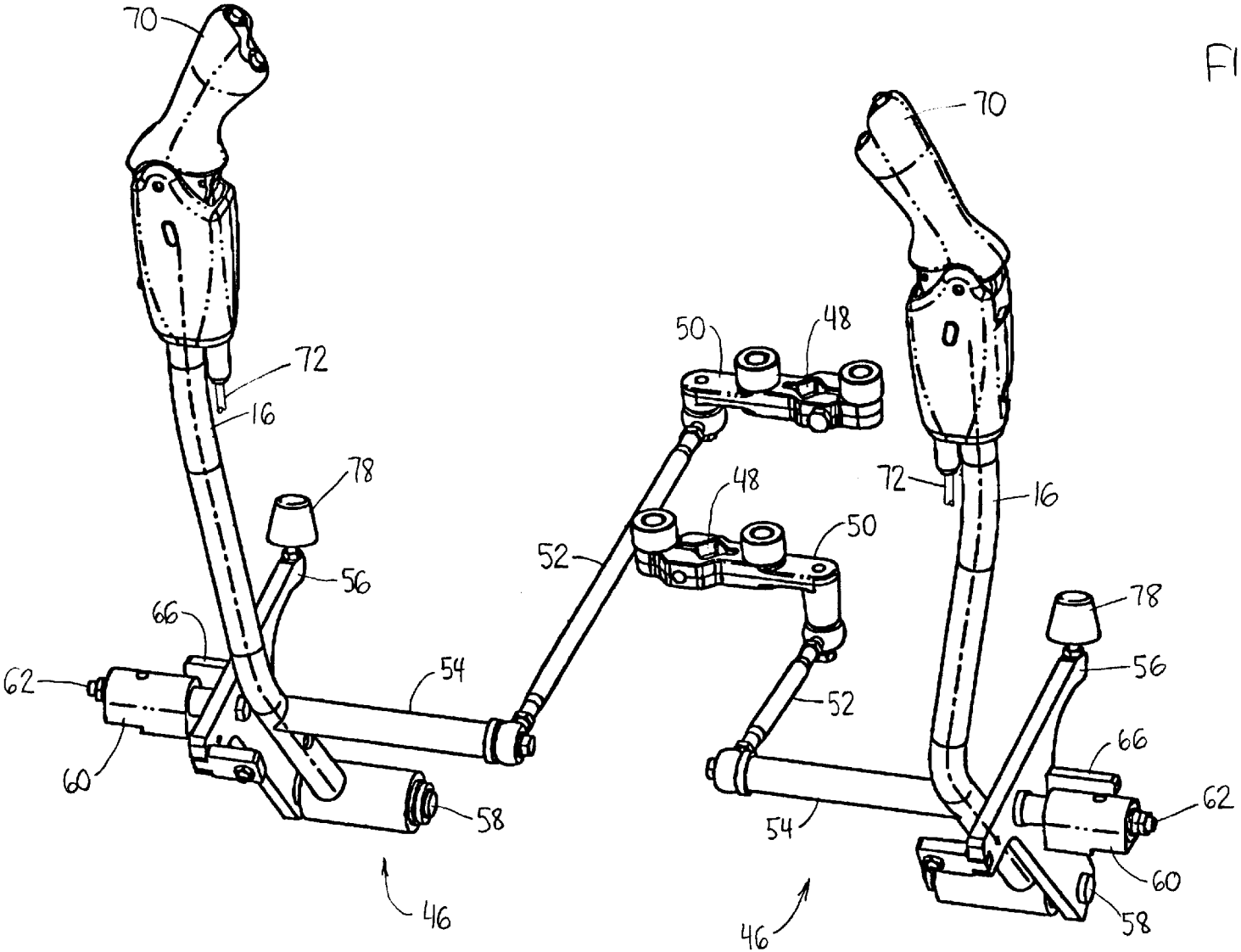
FIG. 5 is a perspective view of the control linkage swung down to its inoperative position when the roll over protection structure has been raised to the position shown in FIG. 3.

The ROPS 22 pivots about a relatively high pivot axis 24 which causes the ROPS 22 to swing substantially forwardly as it begins pivoting upwardly from the position shown in FIGS. 1 and 2. The present invention allows the hand levers 16 to pivot from their operating position shown in FIGS. 1 and 4 to an inoperative position as shown in FIGS. 3 and 5. When in the inoperative position the hand levers 16 provide clearance for the ROPS structure 22 to pivot forwardly and upwardly during its initial range of motion.

The control linkage 46 includes a pair of right and left hand levers 16 which are independently pivotable fore-and-aft by the operator for controlling the speeds of the respective right and left drive wheels 18 and 20. Secondary hand controls are pivotally mounted to the top portions of the hand levers 16. The operator grasps the secondary hand controls 70 during operation of the vehicle 10. With his hands grasping the secondary hand controls 70 the operator will pivot the hand levers 16 fore and aft to drive and steer the vehicle 10. The right and left drive wheels 18 and 20 are each driven by respective hydraulic systems manipulated by the operator via the right and left control linkages 46. A pair of hydraulic system input shafts 48 pivot for controlling the speed and direction of the respective drive wheels 18 and 20. Arm structures 50 are fixed with the hydraulic system input shafts 48. Motion transmitting links 52 extend forwardly from the arm structure 50 and are operatively coupled with respective hand levers 16 via shafts 54. The hand levers 16 are pivotally coupled with lever links 56 whose positions remain stationary during vehicle operation. The hand levers 16 are pivotable by the operator fore-and-aft about a first pivot axis 58 to effectively shift the motion transmitting links 52 fore-or-aft, which swings the arm structures 50 and hydraulic system input shafts 48 to their various positions for manipulating the speed of the respective ground wheels 18 and 20. The lever links 56 are pivotally mounted to brackets 60 for rotation about a second pivot axis 62 as the hand levers 16 pivot between operative and inoperative positions to allow the ROPS structure 22 to pivot between its raised and lowered positions. Bumpers 78 form part of the lever link 56 and contact the floor portion 32 of the ROPS structure 22 for pivoting the lever link 56 and hand lever 16 between the operative and inoperative positions. The brackets 60 are fixed as by bolts to the frame 28 of the skid steer loader 10. A flexible boot 74 encloses the hand lever 16, and is flexible for allowing the hand lever 16 to pivot to its various forward and reverse operating positions, and also allows the control linkage to pivot between its operative and inoperative positions.

Figure 6:
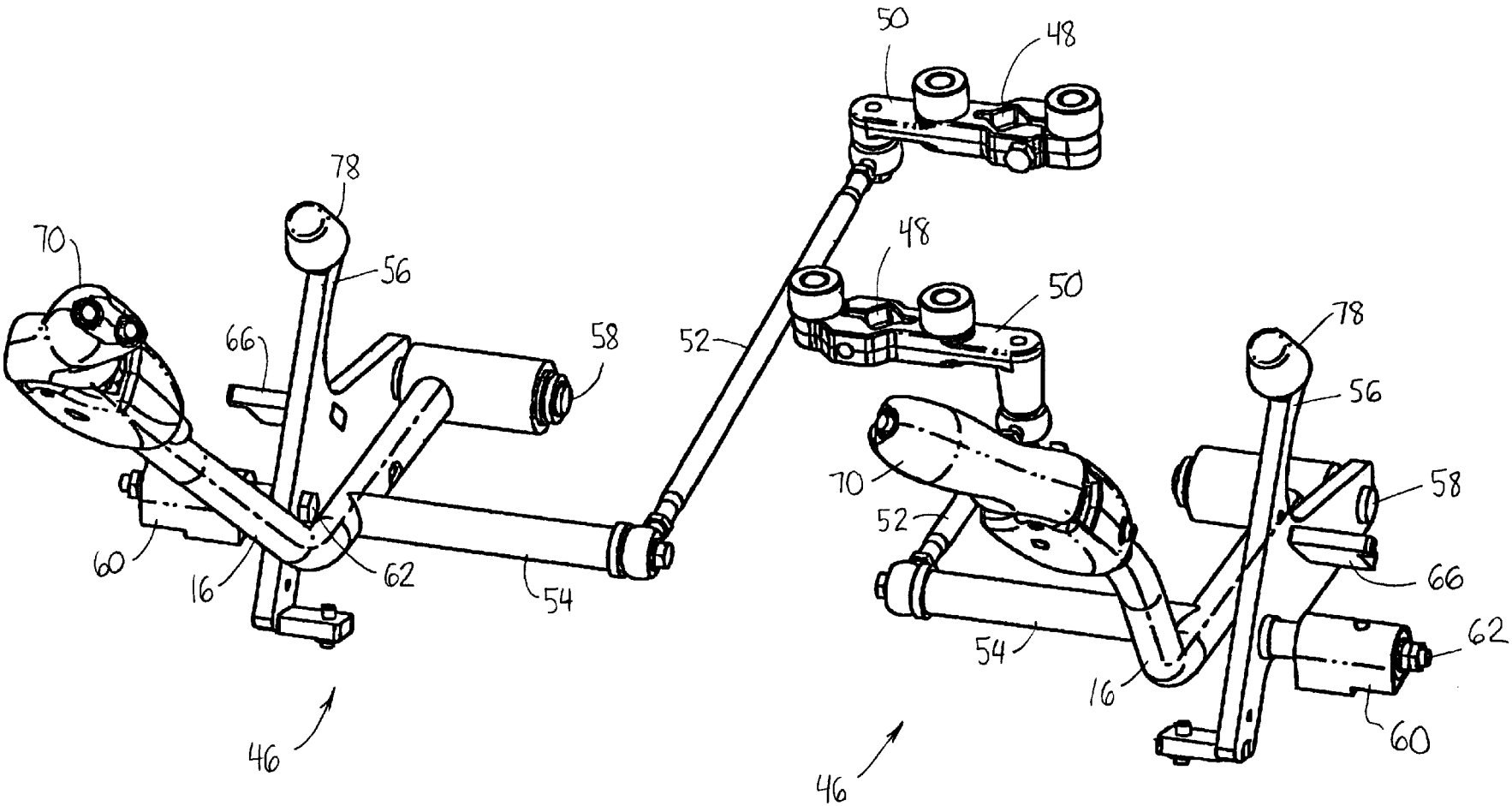
FIG. 6 is a side view of the skid steer loader showing in solid lines the roll over protection structure in the raised position and the hand lever control linkage in its lowered inoperative configuration.

Next, the operation of the present invention will be described in greater detail. With the ROPS 22 in the first operating position as shown in FIGS. 1 and 2, a lower edge portion 64 of the floor portion 32 abuts against and presses downwardly on the lever link 56 via the bumper 78, as best seen in FIG. 6. The lever link 56 is thereby held firmly in position by the underside of the floor portion 32 when the ROPS 22 are down in their first operating position. The hand lever 16 which is coupled with the lever link 56 is thereby also retained in its operating position as shown in FIG. 4 and in phantom lines in FIG. 6. In this configuration, the hand levers 16 can be manipulated fore-and-aft by the operator for shifting the motion transmitting links 52 and arm structures 50, which serves to pivot the respective hydraulic system input shafts 48 and adjust the speed of the respective drive wheels 18 and 20. As the operator shifts the hand levers 16 fore-and-aft, the hand levers 16 pivot with respect to the lever links 56 about the first pivot axis 58.

The ROPS 22 can be pivoted upwardly from the position shown in phantom lines in FIG. 6 to the position shown in solid lines in FIG. 6. As the ROPS 22 swing upwardly about the pivot axis 24 located at the top portion of the pillars 26, the underside of the floor portion 32 swings upwardly therewith, which allows the bumper 78 and lever link 56 clearance to pivot upwardly about the second pivot axis 62. The weight of the hand lever 16 and secondary hand control 70 is positioned such that gravity will pull the hand lever 16 downwardly toward the inoperative position when the ROPS 22 are pivoted upwardly. In other words, gravity biases the hand lever 16 and lever link 56 to pivot forwardly about the second pivot axis 62 as the ROPS 22 are pivoted upwardly by the operator. With the ROPS 22 pivoted to the second position and the control linkage 46 pivoted to the inoperative position, the operator is provided access to the compartments 30 within the frame 28 of the vehicle 10. The operator seat 14 and floor portion 32 of the operator station 12 swing upwardly with the ROPS 22, and thereby expose the contents of the compartment 30 for service and maintenance.

As the hand levers 16 pivot to their inoperative positions, the vehicle 10 is not driven forward or backward. Pivoting of the hand levers 16 to the inoperative position generally does not cause the hydraulic system input shaft 48 to pivot or the drive wheels 18 and 20 to be driven. The second pivot axis 62 about which the lever link 56 and hand lever 16 pivot as the hand lever 16 swings to its inoperative position is generally aligned with the axis of the shaft 54. As the lever link 56 and hand lever 16 swing to the inoperative position, they will therefore also generally pivot about the axis of the shaft 54. The shaft 54 will therefore not shift fore or aft as the lever link 56 and hand lever 16 pivot to the inoperative position, and little or no motion is transmitted to the motion transmitting link 52. The motion transmitting link 52 therefore remains stationary, which causes the arm structure 50 and hydraulic system input shaft 48 to also remain stationary. The alignment of the second pivot axis 62 with the shaft 54 according to the preferred embodiment of the present invention therefore prevents the vehicle 10 from being driven forwardly or rearwardly by shifting the hand levers 16 between their operative and inoperative positions.

The operator can return the ROPS structure 22 to the first operating position from the second position by grasping the ROPS 22 and swinging the ROPS structure 22 forwardly and downwardly. As the ROPS structure 22 approaches its first operating position, the lower edge portion of the floor portion 32 of the operator station 12 will again abut the bumper 78 of the lever link 56, causing the lever link 56 to swing in an arc about the second pivot axis 62. The hand lever 16 mounted with the lever link 56 will swing upwardly about the second pivot axis 62 to its operative position. As the ROPS 22 fully returns to the first operating position, the lower surface portion of the floor portion 32 will firmly press the lever link 56 and hand lever 16 into their operative positions. Tabs 66 formed on the lever links 56 will be captured between the frame 28 and the lower surface portion of the floor portion 32 when the ROPS 22 are in the first operating position, and thereby securely hold the lever link 56 in the proper position for vehicle operation.

The present invention allows the ROPS 22 to pivot about a relatively high, rearwardly located pivot axis 24. A high rear pivot axis 24 for the ROPS 68 is desirable since it allows a cross member 44 to extend between the pillars 26 as well as between the top links 40 of the boom arm linkage 36 at a location rearwardly and generally above the head of the operator. The high rearward position of the cross member 44 allows the top link members 40 to be stabilized or rigidified during boom operation, and is positioned high enough to be out of the operator's field of view. The high cross member 44 therefore does not obstruct the operator's field of vision since it is located generally above the seated operator's head. The high cross member 44 might interfere with the pivotal motion of prior art ROPS structures which swing upwardly to an operative position. The high pivot axis 24 of the ROPS structure 22 according to the preferred embodiment of the present invention allows the ROPS structure 22 to pivot upwardly and rearwardly without being blocked by the presence of the high cross member 44. The high pivot axis 24 of the ROPS structure 22 causes the ROPS 22 to swing forwardly substantially during its initial range of motion from the first operating position to the second position. The pivoting control linkage 46 according to the preferred embodiment of the present invention causes the control levers 16 to shift out of the way of the pivoting ROPS 22 in the ROPS' initial range of motion. The pivoting control levers 16 according to the present invention therefore allow a ROPS structure 22 to be pivotable about a high pivot axis 24 and a high cross member 44 to be provided between the top links 40 of the boom arm structure 36.

With the ROPS structure 22 pivoted upwardly to its second position for providing access to the vehicle compartments 30 beneath the seat 14 and floor portion 32 of the operator station 12, the hand control levers 16 are pivoted forwardly to their inoperative position. In the inoperative position the hand levers 16 are in a lowered position generally out of the operator's way and provide greater access to the vehicle compartments 30 when the ROPS 22 are swung upwardly to the second position. The hand levers 16 pivot automatically between their operative and inoperative positions as the ROPS 22 pivots, and require little or no additional effort or manipulation by the operator. The weight of the hand levers 16 shifts the levers 16 to their inoperative position when the ROPS 22 swing upwardly, and the abutment of the ROPS 22 against the linkage 46 swings the hand levers 16 back to their operative positions when the ROPS 22 swing downwardly. Springs or other biasing mechanisms could also be provided for biasing the hand levers 16 and control linkage 46 toward the inoperative position.

The operator will grasp the secondary hand controls 70 during operation of the vehicle. With his hands grasping the secondary hand controls 70 the operator will pivot the hand levers fore and aft to drive and steer the vehicle 10. The secondary hand controls 70 are pivotable side to side with respect to the hand levers 16 for controlling other vehicle functions such as tilting of the bucket 34 with respect to the boom arm 38. One end portion of a cable 72 is operatively coupled with the secondary hand control levers 70. The cables 72 extend downwardly within the hand levers 16 and have opposite end portions that are operatively coupled with the other vehicle components such as the hydraulic components that cause the bucket 34 to tilt. The cable 72 is pulled in response to manipulation of the secondary hand controls 70, and this shifting of the cables 72 controls the other vehicle functions such as bucket tilt.

I claim:

1. A mechanism controlling operation of a vehicle, comprising:

a control linkage engageable by an operator for controlling operation of the vehicle, a roll over protection structure mounted with the vehicle and being shiftable between a first operating position and a second position whereat a vehicle compartment is exposed for access by an operator, wherein said control linkage is shiftable between an operative position whereat the linkage is engageable by the operator for controlling operation of the vehicle and an inoperative position whereat the control linkage is positioned to allow clearance for the roll over protection structure to shift between the first and second positions.

2. The invention of claim 1, wherein said control linkage operatively engages the roll over protection structure for being shifted between the operative position and the inoperative position as the roll over protection structure shifts between the first and second positions.

3. The invention of claim 1, wherein said control linkage includes a hand lever which pivots from a generally upright operative position downwardly to the inoperative position.

4. The invention of claim 2, wherein said control linkage includes a hand lever which pivots from a generally upright operative position downwardly to the inoperative position as the roll over protection structure pivots upwardly from the first position to the second position.

5. The invention of claim 4, wherein said control linkage includes a lever link which operatively abuts a portion of the roll over protection structure for swinging the hand lever between the operative and inoperative positions as the roll over protection structure pivots between the first and second positions.

6. The invention of claim 5, wherein said hand lever is pivotally coupled with said lever link for pivotal motion about a first axis, said lever link being operatively pivotally mounted with the vehicle for pivotal motion about a second pivot axis offset from said first pivot axis, and a motion transmitting link operatively extends between the hand lever and a vehicle component for transmitting motion of the hand lever to the vehicle component as the operator shifts the hand lever during operation of the vehicle, said motion transmitting link being coupled with the hand lever in proximate alignment with the second pivot axis.

7. The invention of claim 5, wherein said lever link is pressed downwardly by the roll over protection structure as the roll over protection structure pivots down toward the first operative position, and downward pivoting of the lever link serves to pivot the hand lever to the upright operative position, and said lever link pivots upwardly in contact with the roll over protection structure as the roll over protection structure pivots toward the second position, and said hand lever pivots downwardly to the inoperative position as the lever link pivots upwardly.

8. The invention of claim 6, wherein said lever link is pressed downwardly by the roll over protection structure as the roll over protection structure pivots downwardly to the first operative position, and downward pivoting of the lever link serves to pivot the hand lever to the upright operative position, and said lever link pivots upwardly in contact with the roll over protection structure as the roll over protection structure pivots toward the second position, and said hand lever pivots downwardly to the inoperative position as the lever link pivots upwardly.

9. The invention of claim 8, wherein said vehicle is a skid steer loader and said hand control controls the operation of a drive wheel.

10. The invention of claim 5, wherein said hand lever is biased toward the inoperative position, and said roll over protection structure abuts the lever link for pivoting the hand control to the operative position as the roll over protection structure pivots downwardly to the first operating position, and the bias forces the hand control linkage to the inoperative position when the roll over protection structure pivots to the second position.

11. The invention of claim 6, wherein said hand lever is biased toward the inoperative position, and said roll over protection structure abuts the lever link and thereby pivots the hand control to the operative position as the roll over protection structure pivots downwardly to the first operating position, and the bias forces the hand control linkage to the inoperative position when the roll over protection structure pivots to the second position.

12. The invention of claim 7, wherein said hand lever is biased toward the inoperative position, and said roll over protection structure abuts the lever link and thereby pivots the hand control to the operative position as the roll over protection structure pivots downwardly to the first operating position, and the bias forces the hand control linkage to the inoperative position when the roll over protection structure pivots to the second position.

13. The invention of claim 8, wherein said hand lever is biased toward the inoperative position, and said roll over protection structure abuts the lever link and thereby pivots the hand control to the operative position as the roll over protection structure pivots downwardly to the first operating position, and the bias forces the hand control linkage to the inoperative position when the roll over protection structure pivots to the second position.

14. The invention of claim 13, wherein said vehicle is a skid steer loader and said hand control controls the operation of a drive wheel.

15. The invention of claim 10, wherein the weight of the hand control biases the hand control toward the inoperative position.

16. The invention of claim 11, wherein the weight of the hand control biases the hand control toward the inoperative position.

17. The invention of claim 12, wherein the weight of the hand control biases the hand control toward the inoperative position.

18. The invention of claim 13, wherein the weight of the hand control biases the hand control toward the inoperative position.

* * * * *